United States Patent [19]

Nagashima et al.

[11] 4,241,904

[45] Dec. 30, 1980

[54] MOLTEN-METAL TREATING VESSEL

[75] Inventors: Sachio Nagashima; Makoto Wake, both of Ohita, Japan

[73] Assignee: Nippon Steel Corporation, Tokyo, Japan

[21] Appl. No.: 66,284

[22] Filed: Aug. 13, 1979

[30] Foreign Application Priority Data

| | | | |
|---|---|---|---|
| Aug. 18, 1978 | [JP] | Japan | 53/100036 |
| Mar. 19, 1979 | [JP] | Japan | 54/32044 |
| Jul. 17, 1979 | [JP] | Japan | 54/90624 |

[51] Int. Cl.[3] ..... C21C 7/10

[52] U.S. Cl. ..... 266/209

[58] Field of Search ..... 266/209, 208, 210; 75/49

[56] References Cited

U.S. PATENT DOCUMENTS

| | | | |
|---|---|---|---|
| 3,320,053 | 5/1967 | Lehman | 75/49 |
| 3,468,525 | 9/1969 | Kawawa | 75/49 |
| 3,479,022 | 11/1969 | Coupette | 266/210 |
| 3,689,046 | 9/1972 | Die Bie | 266/210 |
| 4,071,356 | 1/1978 | Yamamoto | 75/49 |

*Primary Examiner*—P. D. Rosenberg

*Attorney, Agent, or Firm*—Cushman, Darby & Cushman

[57] ABSTRACT

A molten-metal treating vessel is described having a lower section immersed in a bath of molten metal in a container so that the metal may be treated as desired while it is being partly introduced into and out of the treating vessel in a closed circuit, including a vessel body the lower section of which is open at the lower end, and an immersion drum removably attached to the upper peripheral edge to the lower opening edge of the vessel body and containing upward and downward flow passages. In the treatment vessel disclosed the ratio RS of the total cross sectional area ($S_1+S_2$) of the upward and downward flow passages, which is the sum of the total cross sectional area $S_1$ of the upward passages and that $S_2$ of the downward passages, to the cross sectional area S of the opening at the lower end of the lower section of the vessel is not less than 0.3.

9 Claims, 22 Drawing Figures

MOLTEN-METAL TREATING VESSEL

BACKGROUND OF THE INVENTION

The present invention relates to a molten-metal treating vessel which comprises a vessel body having a drum directly connected to its bottom, the bottom of the drum adapted to be partially immersed in a bath of molten metal within a container to convey the melt out of the metal container into the treatment vessel and back again in a circulatory manner, so that during the course of refluxing the molten metal is treated in the manner desired, for example, for degassing or for refining the molten metal by the addition of one or more alloying elements or modifying additives such as desulfurizing and dephosphorizing agents, either added or blown into the bath, or by a blast of oxygen. In the following description and attached figures the conventional equipment is designated by a zero both in the discussion and in the drawings.

Conventional molten-metal treating vessels, for example, RH degassing vessels are, constructed as typically shown in FIG. 01(*a*)(*b*), so that the vessel body 01 is usually constituted by upper and lower sections 02, 03, which are separable for replacement because of different degrees of melting loss they suffer in operation, and two pipes 05, 06 for upward and downward flows are provided below a bottom wall 04 of the lower section 03 of the vessel, with immersion pipes 07, 08 detachably connected, respectively, to the lower ends of the upward and downward pipes 05, 06.

Another prior known vessel, for example, of the type described in Japanese Utility Model Publication No. 29526/71 and illustrated in FIG. 02(*a*)(*b*), has three molten-steel suction pipes 05 (or possibly more) and one discharge pipe 06 secured to the bottom wall of the lower section 03 of the vessel, with immersion or extension pipes 07, 08 removably connected to the respective pipes 05, 06.

Still another apparatus disclosed in Japanese Utility Model Publication No. 5205/66 is or a one-piece construction as shown in FIG. 03(*a*), with the bottom wall 04 of the lower vessel section 03 integrally secured to upward and downward pipes 05, 06 and immersion pipes 07, 08.

These treating vessels generally known in the art are designed to perform various treatments by immersing the lower portions of the immersion pipes into a bath of molten metal 010 in a ladle 09, conveying the molten metal upward with suction by vacuum into the lower vessel section 03, to a predetermined height from the bottom wall 04, blowing an inert gas such as argon into one of the intake immersion pipes 07, while maintaining the molten metal in the lower section at the predetermined level, and thereby producing an upward flow in the particular immersion pipe and a downward flow in the other immersion pipe, so that the molten metal in the closed circuit is continuously conveyed upward into the lower section, over the bottom wall, and downward out of the vessel during this procedure the molten metal may be degassed or subjected to one or more of the above-mentioned treatments simultaneously with the degasification. These treating vessel 01 are highly evacuated in operation, because it was previously believed effective for the purposes of degassing and other molten metal treatments.

However, conventional vessels such as 01 of the type described have presented the following problems:

(1) As a high degree of vacuum is created in the treating vessel 01, the molten metal rises into the lower section 03 of the vessel, eventually to a height h (see FIG. 01) of about 1.5 meters as measured from the normal free surface of the molten metal in the ladle 09. The height $h_1$ of rise of the molten metal in the lower vessel section as measured from the bottom wall 04 depends both upon the lengths of the upward and downward pipes 05, 06 and the immersion pipes 07, 08 into the molten metal. On the other hand, it is believed desirable for the purposes of the molten metal treatments that the $h_1$ usually be in the range of from 200 to 500 mm. Because of the lengths of the two pipes 05, 06 for the upward and downward flows and also of their associated immersion pipes 07, 08, the free surface or level of molten metal on the bottom wall 04 of the lower vessel section 03 is high above that of the bath in the container. This requires the use of a large-capacity evacuating means to draw the molten metal upward with suction using a high degree of vacuum. In addition, the high-vacuum treatment causes frequent splashes to considerable heights within the vessel 01, making it necessary to employ an otherwise unnecessary tall upper vessel section 02 for connection with the lower section 03. Moreover, the deposition of molten metal on the lining wall 011 on the inside of the vessel must be avoided by providing heater means adjacent those inner wall portions liable to be splashed. Consequently, the treating vessel body 01 that consists of the upper and lower vessel sections 02, 03 and the bottom wall 04 must be large in size and complex in construction.

(2) The cross sectional area of the bottom wall of the lower section 03 of the molten-metal treating vessel 01 is comparatively generally wider than the sum of the total sectional area of molten-metal flow passages inside the upward and downward pipes 05, 06 which are provided under the bottom wall. Because it has been conventionally believed that the wider the total liquid metal surface in the lower section 03 of the vessel 01 becomes, the more effective the molten-metal is degassed or subjected to other treatments.

However, in such a case, the exposed surface of the flow flux of molten metal formed between the immersion pipe 07 of the upward pipe 05 and the immersion pipe 08 of the downward pipe 06 over the surface of the bottom wall 04 accounts for a very limited percentage of the total liquid metal surface in the lower section 03 of the vessel. This means that the amount of molten metal retained in the lower section is so large that degasification or various other treatments that accompany the degasification cannot be efficiently carried out. Accordingly, it has been customary to increase the number of circuits or passes of the molten metal circulation or reflux, thus extending the treating time and lowering the metal temperature, with the result that the upward and downward pipes 05, 06, the immersion pipes 07, 08 connected thereto, and the bottom wall 04 and surrounding side wall 012 of the lower vessel section 03 have been seriously damaged by melting and consequently their operational life has been shortened. Accordingly it has been necessary to replace such parts at rather frequent intervals.

The apparatus according to Japanese Utility Model Publication No. 29526/71, as illustrated in FIG. 02(*a*), includes three or more suction or intake pipes. Since the required refractory lining adds greatly to the wall thickness of each such pipe, an increased number of pipes necessarily means an increased overall wall thickness. As a consequence, the sum of cross sectional areas of the flow passages for the molten metal is limited, and an adequate upward flow by suction of molten steel cannot be accomplished.

(3) The construction of the lower vessel section 03 is further complicated, as shown in FIGS. 01(*a*) and 02(*a*), with the upward pipe 05, downward pipe 06, and immersion pipes 07, 08, individually secured or connected to the bottom wall 04 of the treating vessel body 01, or is complex and difficult to construct, as apparent in FIG. 03(*a*) (*b*), as the upward and downward pipes 05, 06 and their immersion pipes 07, 08 are integrally formed and connected to the bottom wall 04 of the lower section 03. To extend their life, very frequent repairs are necessary with attendand labor costs and down time. Particularly, in the arrangements described in Japanese Utility Model Publication No. 5205/66 and illustrated in FIG. 03(*a*), the upper openings of the upward and downward pipes 05, 06 are directed away from each other, and therefore the side wall portions of the bottom section of the vessel 03 upon which the stream of molten metal impinge tend to become partly melted and damaged. To avoid this, the upper openings and the surrounding wall portions of the bottom must be kept a substantial distance apart. In addition, a refractory molding 041, for example, must be employed as the bottom wall 04 for directing the flow of liquid metal in opposite directions. For these reasons, the volume of the treatment vessel must inevitably be large in size.

(4) Further, as indicated above, such vessel bodies 01 for treating molten metal have limitations as to their construction and fabrication. For example, with the treating vessel of FIG. 02(*a*), which includes the downward pipe connected to the center of the bottom wall and surrounded by the plurality of upward pipes, it is necessary, as already pointed out, to use refractory linings of sufficient thickness that line the upward and downward pipes. This renders it impossible to attain the desired reflux velocity by maintaining the ratio of the total cross sectional area of the upward and downward flow passages 05', 06' to the area of the bottom wall 04 over the value discovered by applicants as discussed below. Furthermore, the undue increase in the number of molten metal circuits or passes prolongs the treatment time, resulting in low productivity, substantial temperature drop of liquid metal, increased damage caused by melting, and other problems of the type mentioned already.

A simplified molten-metal treating vessel known, which is contacted with exposed parts of molten metal surface in a container and to introduce addition agents into the metal, while covering the exposed part, at an ordinary pressure and in a non-oxidizing atmosphere. It is merely a cylindrical structure open at the lower end. Because it lacks the function of stirring the molten metal in the container, a gas nozzle or nozzles must be provided at the bottom of the container so that an inert gas may be blown into the bath for the agitation purpose. In addition, the cylindrical structure must be set in an immersion position such that the inert gas blown into the bath will force the slug sideways and the cylinder covers just the exposed and raised part of molten metal. These operational requirements extremely complicates the treating operation. Moreover, because the addition agents have to be introduced into the very narrow raised part of molten metal, it is important to blow a large volume of the inert gas into the bath for agitation over a long period of time in order that the additives be thoroughly added to and melted in the bath. The molten metal temperature naturally drops sharply during this procedure, which is a distinct disadvantage.

An apparatus of this type of construction is also used in a process for degassing molten metal in a low vacuum, for example, within a range from 10 to 300 mmHg as proposed by U.S. Pat. No. 4,152,140.

With such an apparatus one encounters the same problems as are involved in the degasification in a high vacuum, as already described.

SUMMARY OF THE INVENTION

An object of the present invention is to provide a vessel for treating molten metal which is capable of treating a large quantity of molten metal efficiently within a short period of time, is small in size and simple in construction, and easy to fabricate and repair the inner lining of the vessel.

The present invention solves all of the above-mentioned problems of conventional molten-metal treating vessels.

The object of the invention is realized by providing a molten-metal treating vessel whose immersion drum is immersed in a bath of molten metal in a container so that the metal may be treated, as desired, while a portion of the metal is introduced into and out of the vessel in a closed circuit. The vessel includes a vessel body the lower section of which is open at the lower end, and an immersion drum removably connected at the upper peripheral edge to the lower opening edge of the vessel body, the immersion drum including upward and downward flow passages constructed therein. The vessel of the invention is characterized by a construction having that the ratio RS of the total cross sectional area ($S_1+S_2$) of the upward and downward flow passages, which is the sum of the least total cross sectional area $S_1$ of the singular or plural upward passages and that $S_2$ of the singular or plural downward passages, to the cross sectional area S of the opening at the lower end of the lower section of the vessel is not less than 0.3.

In FIG. 2(*a*), the cross-sectional area S corresponds to an area of the opening whose circumference is surrounded by a most inner edge 55 of the lower end of the lower section 5 (that is, the conical treating zone 5) of the vessel 3 and a most inner edge 44 of a upper peripheral edge of the immersion drum 4 is removably attached to the most inner edge 55.

In FIG. 2(*a*), area $S_1$ corresponds to any sectional area of the upward flow passage A, and area $S_2$ corresponds to any sectional are of the downward flow passage B.

In FIG. 6, area $S_1$ corresponds to lowermost (or smallest) sectional area of the upward flow passage A, and area $S_2$ corresponds to lowermost (or smallest) sectional area of the downward flow passage.

In FIG. 12, area $S_1$ corresponds to total of the sectional areas of two upward flow passages (110; 110'), and area $S_2$ corresponds to the sectional area of one downward flow passage 111.

A maximum value for RS ratio theoretically comes to near 1:

$$RS = \frac{S_1 + S_2}{S} < 1.$$

BRIEF DESCRIPTION OF THE DRAWINGS

FIG. 01(*b*) is a transverse sectional view of the lower portion of the molten-metal treating vessel, taken along and viewed in the direction of the arrows I—I of FIG. 01(*a*);

FIG. 02(*b*) is a sectional view taken on the line A—A of FIG. 02(*a*);

FIG. 03(*b*) is a transverse sectional view of the lower portion of the vessel, taken along and viewed in the direction of arrows I—I of FIG. 03(*a*). As previously indicated those figures prefixed with a zero are representative of conventional constructions.

FIG. 1 is a partly broken away general side view of one embodiment of the reflux-degassing molten-metal treating apparatus of the present invention;

FIG. 2(*a*) is a vertical cross section view, on an enlarged scale, of the essential operational parts of the lower portion of the embodiment shown in FIG. 1;

FIG. 2(*b*) is an enlarged, vertical cross section view of the essential operational parts, showing an additional partition wall 6″ formed in the lower section of the molten-metal container 1 as an extension of the partition wall 6 of the immersion drum 4 shown in FIG. 1;

FIG. 3 is a transverse sectional view taken along and looking in the direction of the arrows I—I of FIGS. 2(*a*) and (*b*);

DETAILED DESCRIPTION OF THE PREFERRED EMBODIMENTS

The present invention is now described in more detail. The molten-metal treating tank according to the invention has the following features and advantages:

1. The vessel body is bottomless and is open at the lower end, to which the upper peripheral edge of an immersion drum, shaped to and cooperating with one of varied contours matching that of the open lower end and, is removably connected to the lower end, with upward and downward flow passages formed in the immersion drum.

The present invention thus provides a simplified, novel and unobvious modification of the conventional reflux vacuum degassing apparatus. The treating vessel of the present invention dispenses with the bottom wall and the separate upward and downward pipes usually connected to the bottom.

With the construction described, the treating vessel body includes a lower section whose service life depends solely on the life of the lower side wall portion, and provides easy access from the lower open end to the inside for the fabrication and repair of the lining used therein. In addition, the molten metal can be treated immediately above the upper end of the immersion drum. For the treatment of molten metal, it is no longer necessary to use a high vacuum as in the past, and therefore the metal need not be lifted high in the apparatus. During vacuum degassing, for example, the liquid metal can be drawn into the treating vessel by a weak suction force. This is also advantageous because a smaller evacuating means may be used while various degassing treatments can be conveniently performed without splashes.

2. This invention incorporates new information that we have acquired as a result of various experiments, and specifically that the ratio RS of the total cross sectional area ($S_1+S_2$) of the upward and downward flow passages of the immersion drum to the area S of the opening at the lower end of the vessel body should not be less than 0.3. This ratio enables the vessel to attain a remarkable increase in the reflux velocity per unit time, measured in meters per second, of the molten metal in the upward and downward flow passages, as compared with the velocity values of conventional configuration having the usual shaped bottom, thus making possible the treatment of a large quantity of the molten metal efficiently within a short time. A maximum ratio has not, as yet, been determined but best results are obtained in a ratio range of about 0.3 to about near 1.0, depending, of course, on the type of treatment conducted.

Figure 15:
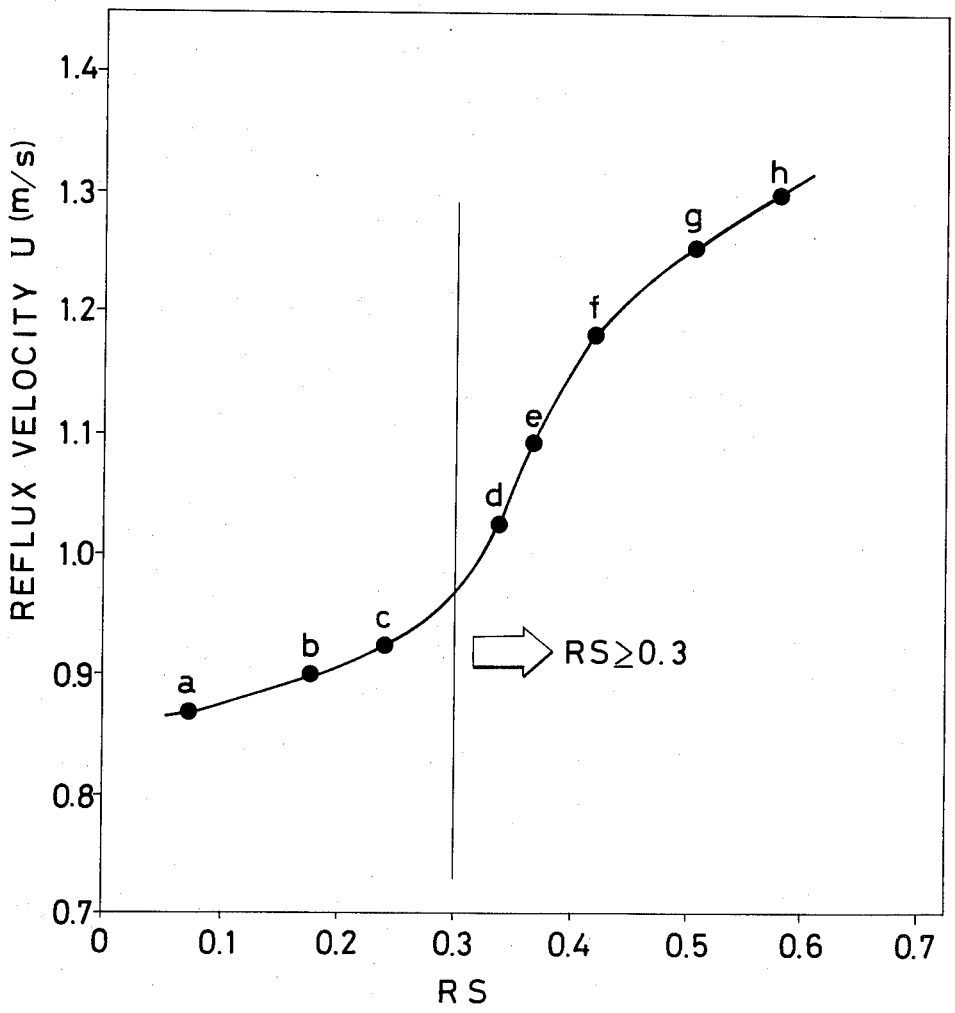
FIG. 15 is a graph showing the relationship between the RS value and reflux velocity u(m/s), in which the vertical line in the center of the graph designates to the left operation according to the present invention.

Table 1 summarizes the results of experiments conducted with the conventional apparatuses (A to C) and with various embodiments of the invention (D to H), giving the conditions of S, $S_1$, $S_2$, RS, conveying gas supplied to the upward flow passage or passage (l/lin), degree of vacuum (mmHg) created in the test vessel, and the reflux velocities (m/sec) obtained experimentally under the varied sets of conditions and an indication of the relevant figure of the drawings. FIG. 15 graphically represents the relationship between the ratio RS and the reflux velocity (m/sec). In these experiments the supply of the gas for the reflux used was a saturated amount to be blown into the molten metal, or approximately 9100 l/min/m$^2$ per unit cross sectional area, $\sigma = 1100$ l/min/m$^2$, and the degree of vacuum was 200 mmHg throughout the experiments.

Figure 1A:
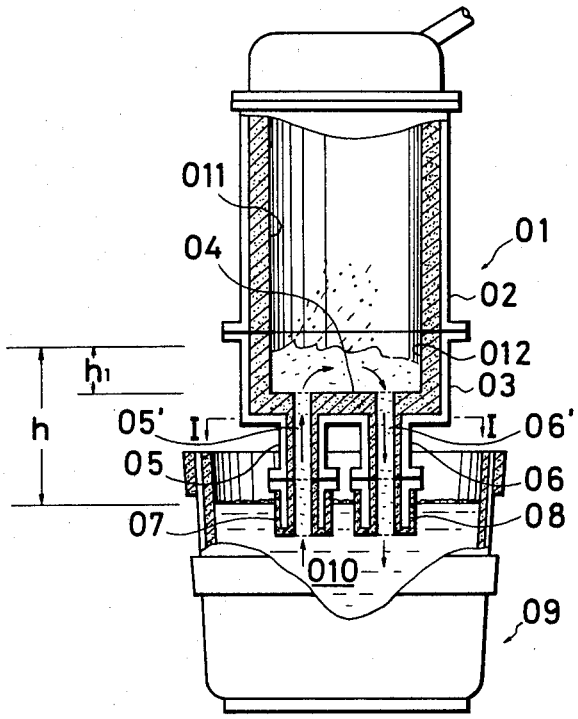
FIG. 01(*a*) is a general side view, partly broken away in vertical section, of a conventional molten-metal treating apparatus of the reflux vacuum degassing type.
Figure 1B:
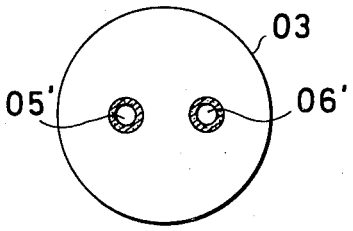
Figure 2A:
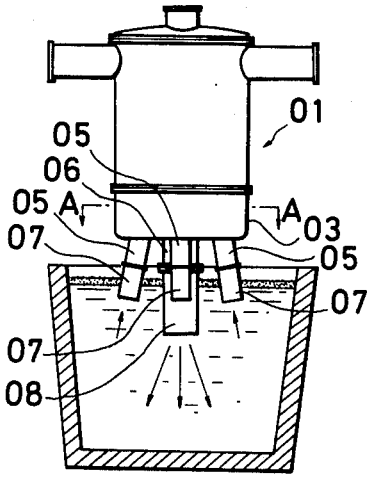
FIG. 02(*a*) is a side view, partially in vertical section, of a conventional reflux vacuum degassing apparatus, showing four molten-steel suction pipes disposed radially outwardly.
Figure 2B:
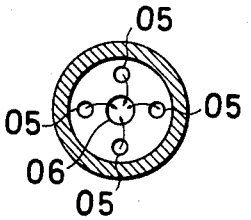
Figure 3A:
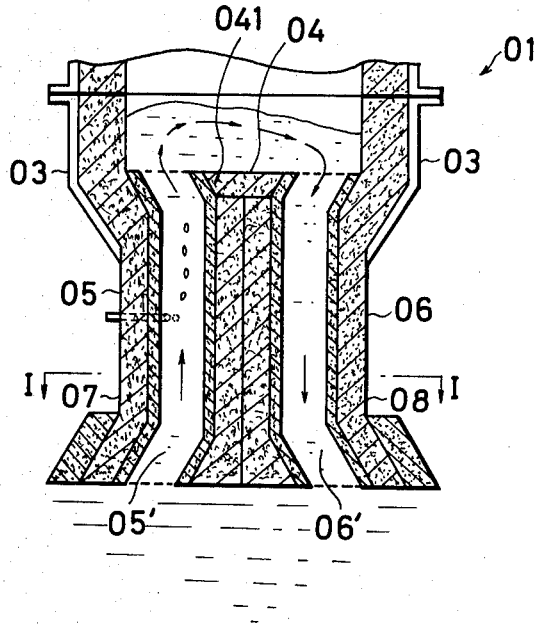
FIG. 03(*a*) is a broken away vertical sectional view of the lower portion of a conventional molten-metal treating vessel of the reflux vacuum degassing type showing inlet and outlet pipes formed integrally as a twin pipe arrangement.
Figure 3B:
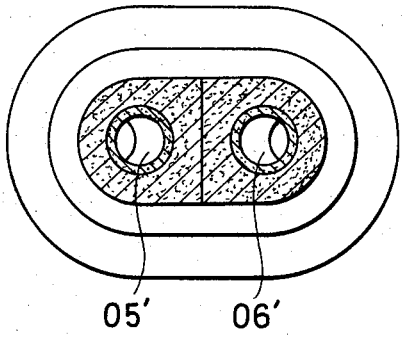
Figure 1:
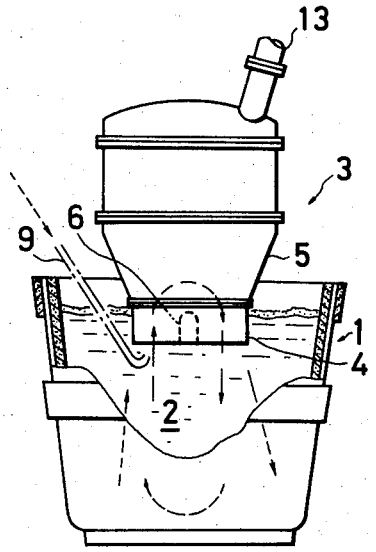
Figure 3:
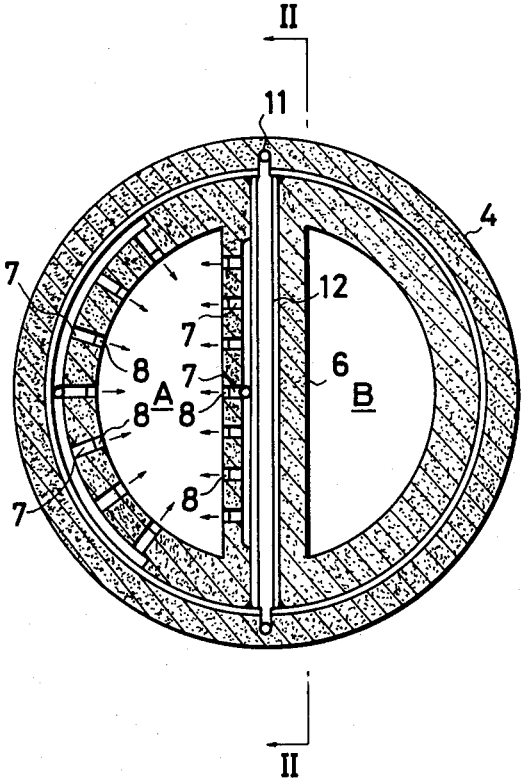

With conventional molten-metal treating vessels as shown in FIGS. 01 to 03, the RS values are at most about 0.245, as indicated in Table 1. The reflux velocity values, too, are only about 0.92 m/s.

As will be apparent from Table 1 and FIG. 15, the reflux velocity (m/sec) drops sharply with a decrease of RS to less than 0.3 but rises steeply with an increase of RS to more than 0.3. We have acquired this new information from the experiments with the immersion drum. The construction of the drum that constitutes a characterizing feature of the present invention, as already described, has made it possible to form upward and downward flow passages with an RS value as high as desired, particularly in excess of 0.3. This second characterizing feature is sexplained in more detail below.

An embodiment constructed to have a high RS value will be considered first. As shown in FIG. 3, the flow-passage space inside the immersion drum is divided, for example, into halves by a weir-like partition wall to define upward and downward flow passages, and a gas for conveying the molten metal is blown into the upward flow passage from porous-brick openings at the inner ends of nozzle holes formed through the inner surrounding walls of that passage, from separate gas injection pipes or the like.

TABLE 1

Figure 7:
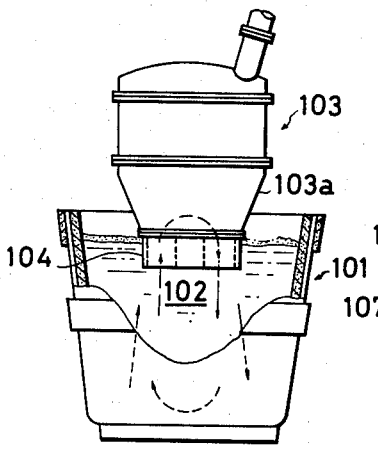
FIG. 7 is a partly broken away general side view of still another embodiment of the present invention.
Figure 8:
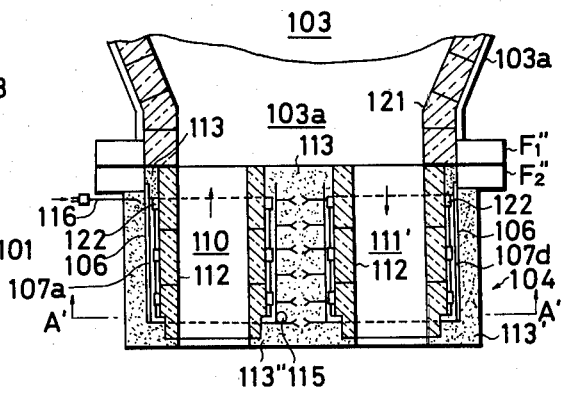
FIG. 8 is an enlarged vertical side section view taken along and looking in the direction of the arrows A—A of FIG. 9.
Figure 9:
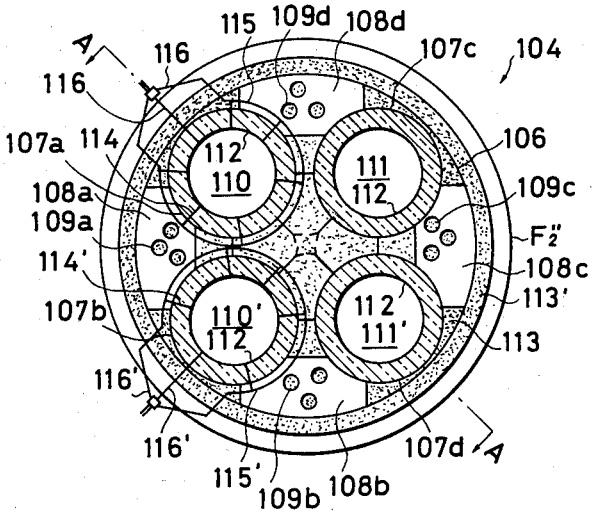
FIG. 9 is an enlarged transverse top sectional view taken along and in the direction of the arrows A′—A′ of FIG. 8.
Figure 11:
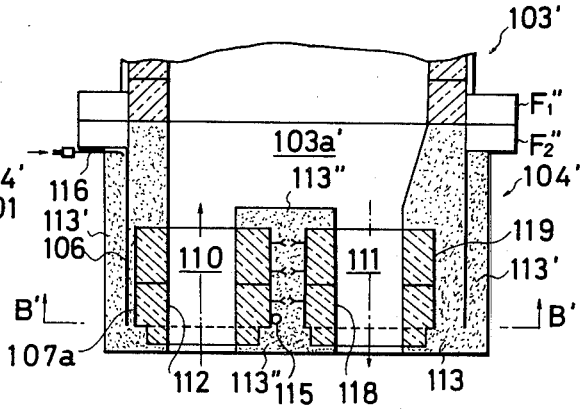
FIG. 11 is an enlarged vertical section view taken along and looking in the direction of the arrows B—B of FIG. 12.
Figure 12:
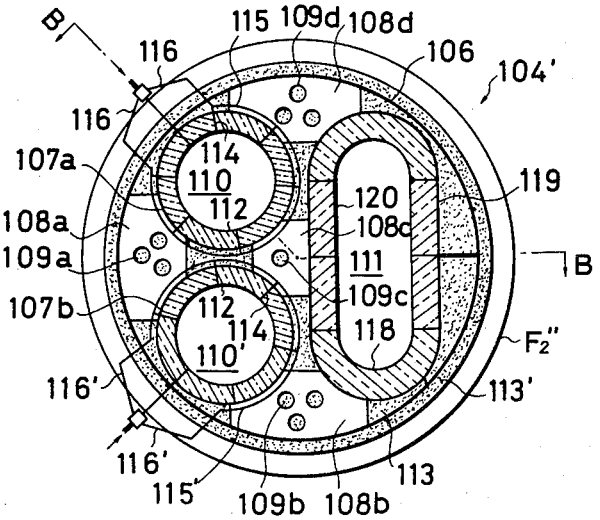
FIG. 12 is an enlarged transverse sectional view taken along and viewed in the direction of the arrows B′—B′ of FIG. 11.
Figure 13:
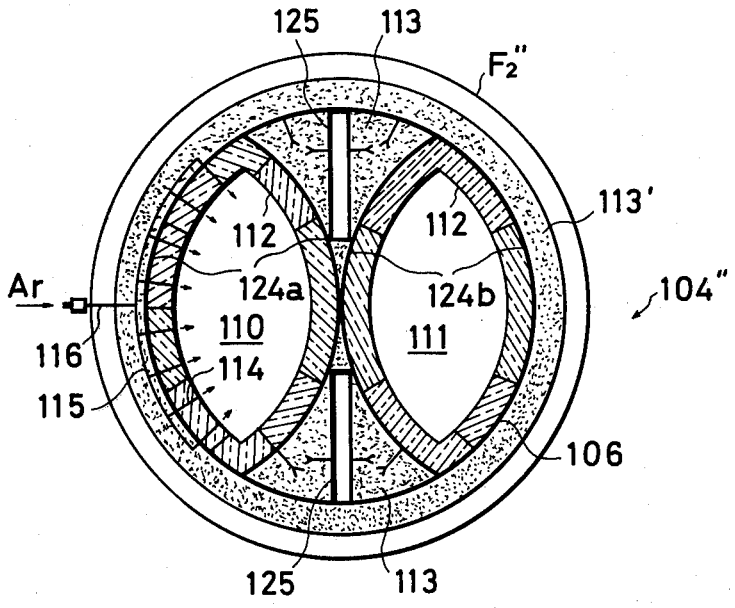
FIG. 13 is an enlarged transverse section view of a modified form of the immersion drum according to the present invention.
Figure 14:
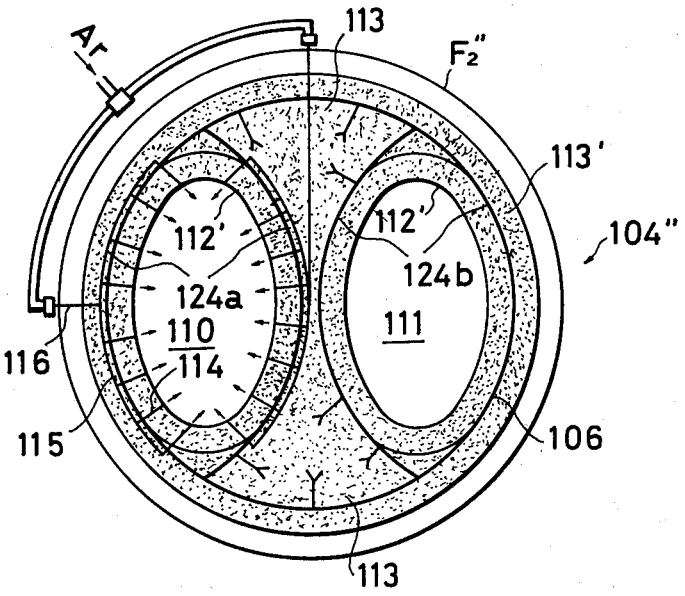
FIG. 14 is an enlarged view similar to FIG. 13 but showing yet another modification of the immersion drum of the present invention.

| | Vessel shown in | RS | $S_1$ (m$^2$) | $S_2$ (m$^2$) | S (m$^2$) | Conveying gas (1/min) | Vacuum Degree (mmHg) | Reflux velocity (m/s) |
|---|---|---|---|---|---|---|---|---|
| A | FIG. 01 (Existing RH type) | 0.075 | 0.159 | 0.159 | 4.225 | 1000 | 200 | 0.87 |
| B | FIG. 03 | 0.180 | 0.380 | 0.380 | 4.225 | 3500 | 200 | 0.90 |
| C | FIG. 02 | 0.245 | 0.518 | 0.518 | 4.225 | 3500 | 200 | 0.92 |
| D | FIGS. 7–9 (4 passages) | 0.337 | 0.318 | 0.318 | 1.890 | 3000 | 200 | 1.02 |
| E | FIGS. 11–12 (2 circular & 1 elliptical passages) | 0.370 | 0.350 | 0.350 | 1.890 | 3500 | 200 | 1.09 |
| F | FIG. 14 (2 biconvex passages) | 0.420 | 0.400 | 0.400 | 1.890 | 4000 | 200 | 1.18 |
| G | FIG. 13 (2 biconvex passages) | 0.510 | 0.482 | 0.482 | 1.890 | 4500 | 200 | 1.25 |
| H | FIGS. 1–4 (weir-partitioned passages) | 0.582 | 0.550 | 0.550 | 1.890 | 5000 | 200 | 1.30 |

In this way the molten metal is conveyed upward into the treating vessel, and the flux of molten metal toward the downward flow passage is allowed to spread sidewise over the entire top surface of the partition wall, so that the the exposed surface effective for degassing may account for practically the entire molten metal surface inside the vessel. This permits degasification and modification of the metal composition with addition agents to be conducted rapidly and efficiently.

Other configurations forming flow passages in the immersion drum with relatively high RS values include those having a plurality of passages of varied sectional contours, for example, circular (FIG. 9), ellipitcal (FIG. 12), polygonal, or biconvex (FIG. 13) in cross section. The particular cross-sectional configuration is not critical and way be varried widely, as will be appreciated from these figures.

3. In accordance with the present invention, the flow passages of the above described configurations are defined by and lined with regular or preformed fire bricks or by castable refractories, the bricks or refractories being attached or removably attached to support frames or shells, for example, in order that they may be easily and promptly repaired. Those support shells, in turn, are securely mounted in an outer shell that forms the skeleton or foundation of the immersion drum. The spaces between the outer foundation shell and the inner shells and among the inner shells, and the outside of the outer shell are filled or covered with suitable refractory cements or fillers to form a unitary structure, and therefore the immersion drum thus fabricated exhibits great robustness under the thermal loading during the immersion in molten metal.

Further, because the conveying gas is issued either from the porous brick openings at the inner ends of nozzle holes formed through the inner walls of the upward flow passages of the immersion drum or from separate gas injection holes, thereby conveying the molten metal upward into the vessel, the flux of metal toward the downward passage is spread sideways over the entire top surface of the molten metal in the upper section of the drum. As an alternative the lower section of the vessel accounts for substantially the entire surface of the molten metal surface in the lower section of the vessel, whereby the degasification and finishing or modification of the metal composition with addition agents can be performed efficiently within a short period of time.

4. The height of the upper end of the partition wall as the second feature of the invention, or the height of the refractory structure that forms the flow passages of the immersion drum, is suitably chosen according to the levels of the molten metal both in the container and in the vessel as well, and also in consideration of the desired cross sectional contour of the flux of metal in the vessel. The upper end of the partition wall or the refractory structure may be curved, raised, flattened or otherwise shaped depending on the locations of the gas holes in the upward flow passage or passages, distribution of the gas supply, and other related factors as will be apparent from the attached figures. Further, the lower end portions of the flow passages may be such that the inner walls defining the passages are tapered or tilted altogether so that the openings at the lower ends of the upward and downward flow passages of the immersion drum may be directed away from each other directly below the drum. This prevents the so-called short circuiting, a phenomenon in which the downward stream of the treated molten metal joins with the untreated upward stream instead of falling deep into the bath, because the inlet end of the upward flow passage is too close to the outlet of the downward passage.

5. During operation of the apparatus of the present invention, more than lower halves of the outer walls of the immersion drum and the inner walls of all the flow passages therein are surrounded by and kept in contact with the molten metal. For this reason the partition wall, individual inner shells, or support members inside the drum are preferably adapted to be cooled as with a cooling jacket or are provided with a cooling box or boxes. The cooling jacket or box means is communicated with a cooling medium source through the conveying gas nozzles or with separately installed pipes for supplying and discharging a cooling fluid. The cooling protects the inner and outer walls of the immersion drum from partial melting and damage, thereby greatly prolonging their life.

6. With respect to the molten-metal flow passages in the immersion drum, only the upward passage or passages on a given side need be provided with the nozzle holes for issuing the conveying gas into the molten metal to produce an upward flow. Alternatively, the gas holes may be provided in the inner walls of the passages on the both sides so that the passages on the two sides may be used, in turn as upward and downward passages or vice versa. The life of the immersion drum as a whole may be increased in this way.

7. An additional partition wall may be provided in the lower section of the molten-metal treating vessel in the direction corresponding with and extending from the partition wall of the immersion drum, so as to extend the life of the partition wall of the immersion drum.

DETAILED DESCRIPTION OF THE DRAWINGS

Referring now the drawings, and specifically to FIGS. 1 to 4, a molten-metal treating vessel 3 of the vacuum degassing type is shown as an embodiment of the invention. The embodiment is such that, with a negative pressure applied in the vessel, molten metal 2 is lifted by suction from a ladle 1 through an immersion drum 4 into the vessel, where the metal is degassed with or without concomitant modification of the metal composition using one or more additives. In FIGS. 2(*a*) and (*b*), the molten-metal treating vessel 3 includes a conical treating zone 5 which is open at the bottom and is provided with a flange $F_1$ on its lower outer periphery, which mates with a flange $F_2$ on the upper outer periphery of the immersion drum 4 to connect the treating section and the drum together. A partition wall 6 is provided inside the immersion drum 4. The numeral 6'' in FIG. 2(*b*) indicates a partition wall formed in the treating zone 5, that is, in the opening at the lower end of the lower section of the treating vessel. It serves as an extension of the partition wall 6 to prolong the life of the latter and generally extends above the horizontal dashed line into the treating vessel.

Figure 4:
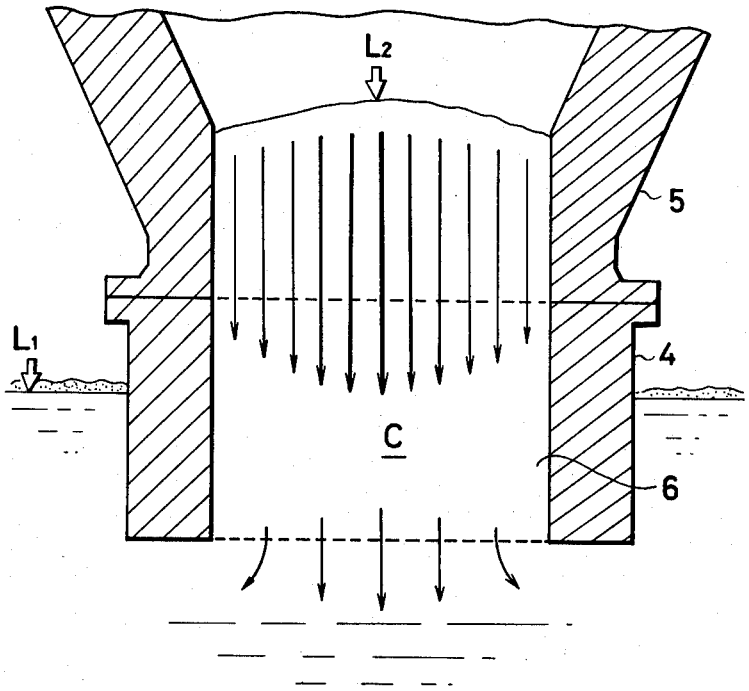
FIG. 4 is a further enlarged vertical sectional view as seen in the direction of the arrows II—II of FIG. 3.

Gas nozzle holes 7 for issuing a gas to convey the molten metal are open on one side of the partition wall 6, with a porous brick opening 8 fitted in the open end of each hole. Similar gas holes 7 are also open on the inner wall of the immersion drum on the opposite side of the partition wall 6. These nozzle holes together define an upward flow passage A, creating a flux C of molten metal, as indicated in FIG. 4, over the entire upper end portion of the partition wall 6, the flux being directed to a downward flow passage B. The height of the upper end of the partition wall is determined by the level of liquid metal $L_1$ in the ladle 1, the level $L_2$ in the treating vessel, and the cross sectional contour of the flux C of metal.

Numeral 9 in FIG. 1 designates a pipe through which the gas is supplied, so that a separate ascending flow can be produced. In FIGS. 2(*a*) and (*b*), an extension 10 of the partition wall 6 is shown protruding downwardly from the lower end of the immersion drum. Since the partition wall 6 is always in contact with the molten metal, a support beam 12 embedded in the wall and is cooled by a cooling fluid being circulated through a piping 11. Numeral 13 in FIG. 1 indicates a pipe leading to a vacuum degassing system (not shown).

Figure 5:
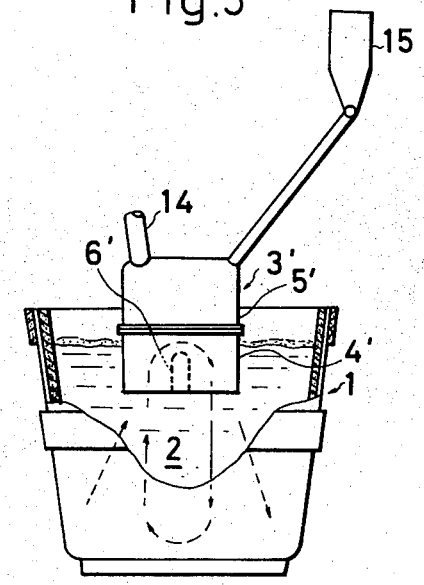
FIG. 5 is a partly broken away general side view of another embodiment of the present invention.
Figure 2A:
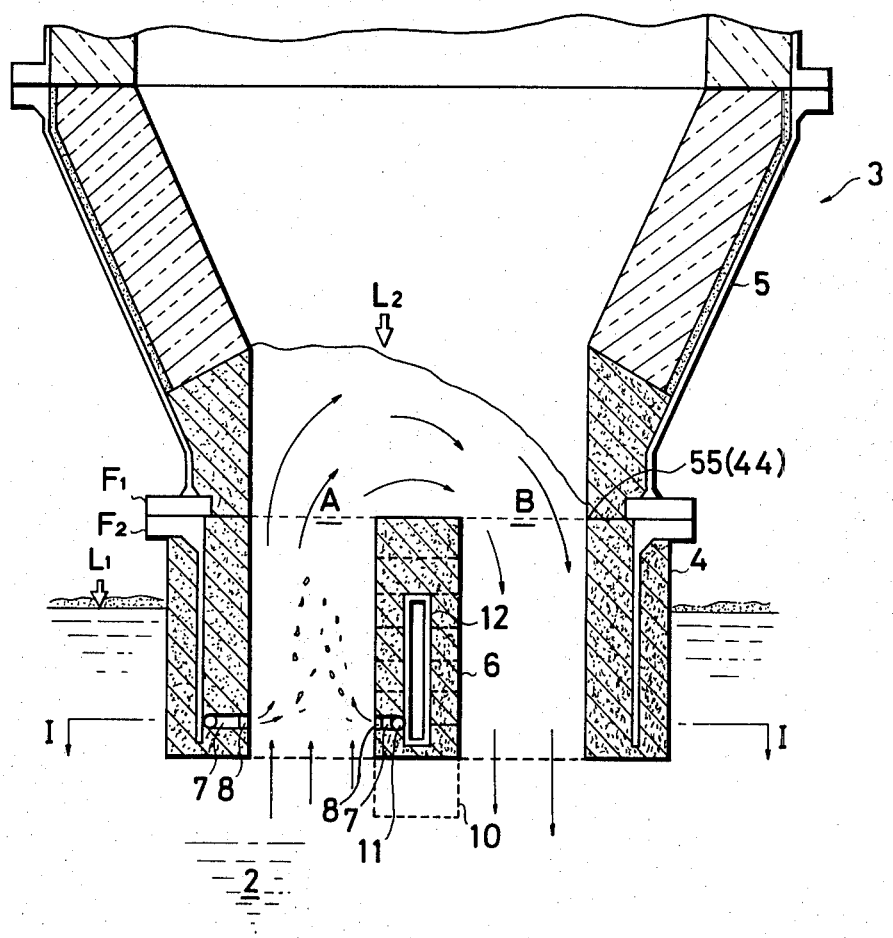
Figure 2B:
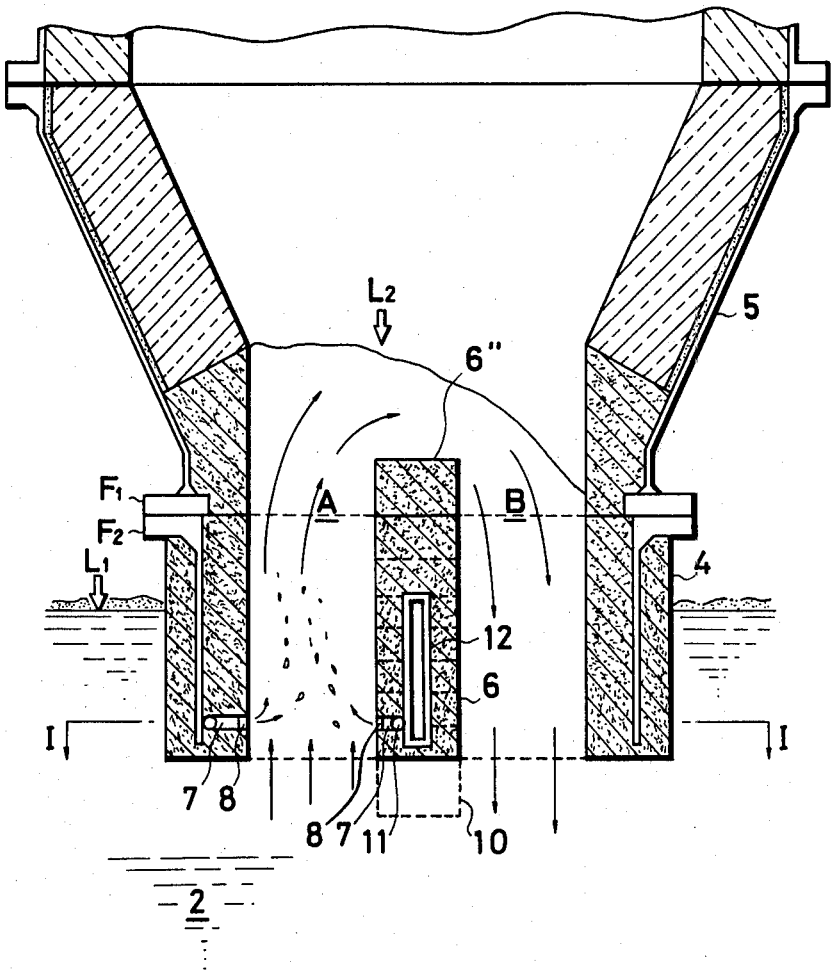
Figure 6:
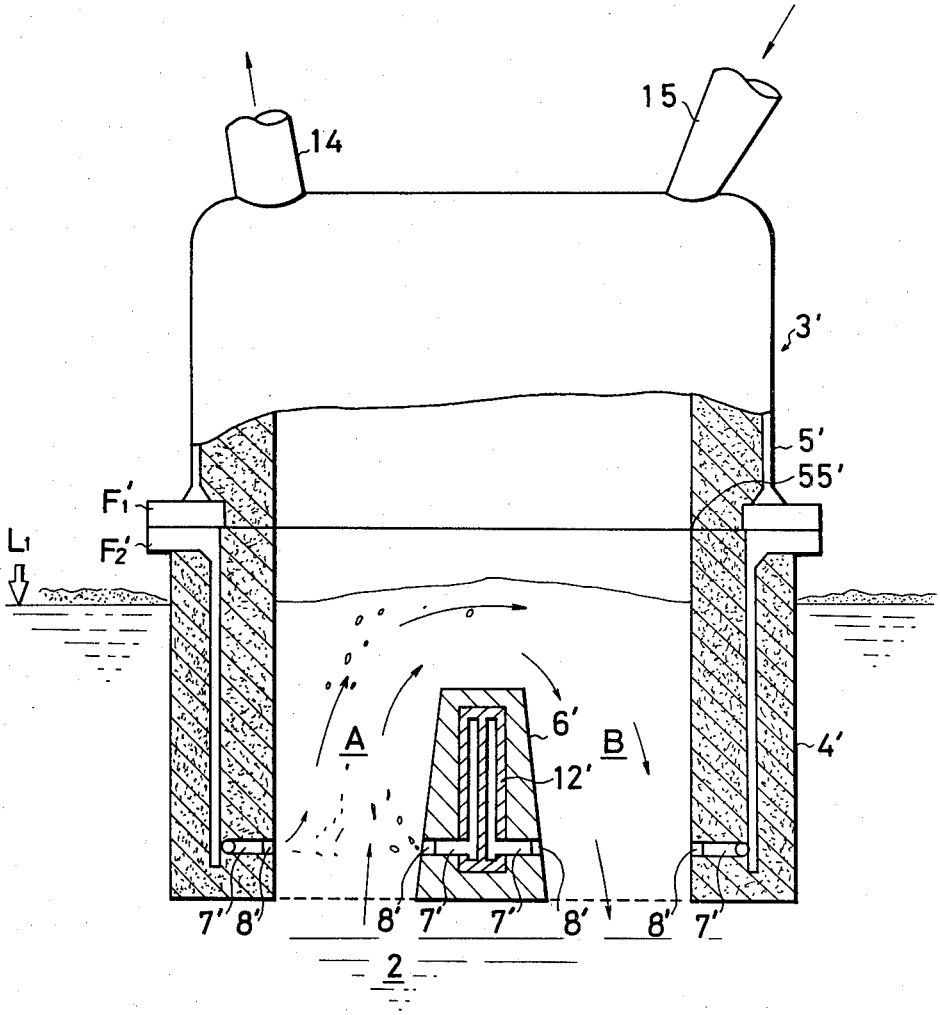
FIG. 6 is an enlarged view, partly in vertical section, of the essential operational parts of FIG. 5.

FIGS. 5 and 6 illustrate another embodiment of the present invention, which is a simplified molten-metal treating vessel 3' having an immersion section 4' connected by means of flanges $F_1'$, $F_2'$ to the lower open end of the vessel body 3' and immersed in the bath of molten metal 2 in a ladle 1, so that addition agents for modifying the metal composition may be conveniently added to the molten metal in the vessel at the operational pressure of the device and in a non-oxidizing atmosphere. Thus, there is no need of providing nozzle holes at the bottom of the container for introducing an inert gas for agitation of the molten metal for increasing the exposure of the molten metal to a vacuum. It is only necessary to immerse the drum 4' to the desired depth from the level $L_1$ in the ladle 1 and issue the conveying gas from the nozzle holes 8' formed at present locations, as indicated, so as to convey a large quantity of molten metal 2 into and out of the immersion drum 2 to accomplish the finishing or modification of the metal composition within a short period of time. The partition wall 6' of this embodiment is tapered inwardly so that the upward and downward flows are placed in the opposite directions immediately underneath the immersion drum. The support beam 12' is conveniently cooled by the conveying gas on its way to the nozzle holes 7'. Pipe 14 is an evacuating line and opening 15 indicates a hopper equipped with supply means for providing alloying elements to be added to the molten metal.

Additional embodiments shown in FIGS. 7 through 14 are now described. The embodiment in FIGS. 7 to 9 includes a molten-metal treating vessel 103 of the reflux vacuum degassing type, which is evacuated to draw by suction the molten metal 102 from a ladle 101 through an immersion drum 104 so as to effect degasification with or without simultaneous modification of the composition using addition agents.

Figure 10:
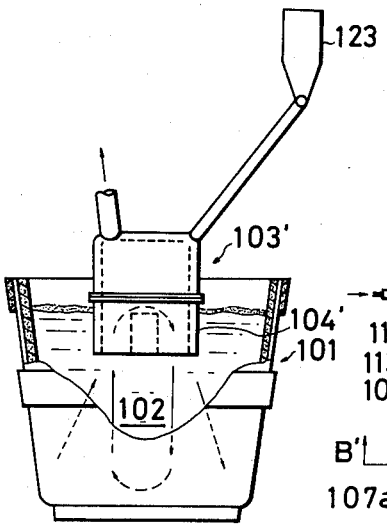
FIG. 10 is a general side view, partly in vertical section, of yet another embodiment of the present invention.

FIGS. 10 to 12 represent a rather simplified molten-metal treating vessel 103' whose lower section formed on an immersion drum 104' is immersed in a bath of molten metal 102 in a ladle 101, with composition-modifying additives from a hopper 123 added to the metal in the vessel at the operational pressure of the device and in a non-oxidizing atmosphere.

Discussing these embodiments in more detail, FIG. 8 is a vertical sectional view of the immersion drum 104 looking in the direction of the arrows A—A of FIG. 9, and FIG. 9 is a transverse sectional view of the same drum as seen in the direction of the arrows A'—A' of FIG. 8.

Similarly, FIG. 11 is a vertical sectional view of the immersion drum 104' looking in the direction of the arrows B—B of FIG. 12, and FIG. 12 is a transverse sectional view of the drum in the direction of the arrows B'—B' of FIG. 11.

Referring now to FIGS. 7 to 9, the vessel body 103 has no bottom but is open at the lower end of its molten-metal treating zone 103*a*'. The outer periphery of the opening is provided with a flange $F_1''$ for purpose of connection, and the entire inner surface of the vessel is lined with fire bricks 121. The immersion drum 104 is cylindrically shaped and consists of an outer cylindrical support frame or shell 106 of iron having at its upper outer periphery a flange $F_2''$ for connection with the cooperating flange $F_1''$. Smaller inner shells 107*a*–107*d* of iron are held within the shell 106, and support pieces 108*a*–108*d* are disposed respectively between the lower ends of the inner shells 107*a*–107*d* and the lower end of the outer shell 106 so as to provide support and reinforcement for the inner shells 107*a*–107*d*. The support pieces 108*a*–108*d* are formed with vertical holes 109*a*–109*d* for the injection of castable refractories. The inner shells 107*a*–107*d* are lined exchangeably with cylindrical fire bricks 112, which may be removed and replaced, to form therein upward flow passages 110, 110' and downward flow passages 111, 111' for the molten metal.

From the injection holes 109*a*–109*d*, castable refractories are filled in and solidified in the spaces between the outer peripheral surfaces of the inner shells 107*a*–107*d* and the inner peripheral surface of the outer shell 106. The outer periphery of the outer shell is also covered with a solidified layer of castable refractories 113'. In addition, the immersion drum 104 fabricated in this way is further covered at both upper and lower ends with solidified castable layers 113', so that the drum is completely covered with the refractories with the exception of the flange $F_2''$. In the cylindrical fire bricks 112 that form the upward flow passages 110, 110', there are disposed nozzle pipes 114, 114' which open in the lower inner surfaces of the passages to inject the molten-metal conveying gas, that is, argon gas to be supplied from the outside through branch pipes 116, 116' and annular header pipes 115, 115' surrounding the outer peripheries of the inner shells 107*a*, 107*b*.

Cooling of the immersion drum 104 of this embodiment of the invention is accomplished by passing a cooling medium through rectangular-shaped cooling pipes 122 extending around the outer periphery of the outer shell 106 and along the inner peripheries of the inner shells 107*a*–107*d*. This cooling system reduces the heavy thermal load on the drum during immersion and permits prolongation of the drum life for longer service.

Referring now to FIGS. 10 to 12 in more detail, the vessel body 103' is of an open bottom type, equal in diameter to the immersion drum 104'. The immersion drum is detachably secured to the peripheral edge of the vessel opening. Other parts similar to those of the preceding embodiments are given like numbers and the description is omitted.

Regarding the immersion drum 104', the components having counterparts in the embodiment of FIGS. 7 to 9 are numbered alike and not here described, only dissimilar parts are here explained.

Within the cylindrical outer shell 106, arcuste fire bricks 118 and rectangular bricks 120 which together form an elliptical downward flow passage 117 for molten metal are replaceably supported by the elliptical-shaped inner shell 119, and cylindrical fire bricks 112 forming upward flow passages 110, 110' are replaceably supported by cylindrical inner shells 107*a*, 107*b*. The elliptical shell 119 and cylindrical shells 107*a*, 107*b* secured within the outer shell 106 are only half the height of the shell 106, and their upper ends are well below the flange $F_2''$ to provide a molten-metal treating zone 103*a*' in the upper half space of the immersion drum 104'. Thus, the upward and downward flow passages 110, 110' and 117, respectively of the immersion drum 104' can be placed in the bath of molten metal 102 in the ladle 101 without the necessity of completely immersing the entire drum into the bath. In this way the treatment of molten metal is possible at normal operational pressures.

In each of the additional embodiments of the present invention shown in FIGS. 13 and 14, the immersion drum 104'' includes molten-metal flow passages 110, 111 which are biconvex in cross section to provide passages of increased cross sectional areas. The support shells 124*a*, 124*b* of the same contour are partly fabricated in common with the outer foundation shell 106. The parts like or similar to those of the preceding embodiments are given like numbers, will be apparent to the reader and the description is not repeated here. In these figures the numeral 125 indicates cooling boxes and 112 indicates flow passage linings formed of castable refractories.

As will be clear from the foregoing description, the molten-metal treating vessel according to this invention is small in size and simple in construction, because the immersion drum is directly connected to the vessel body, thus dispensing with the bottom wall of the vessel and upward and downward pipes each separately connected to the vessel as in conventional arrangements. Moreover, the immersion drum is of a unitary construction, with the both upward and downward flow passages built into the drum. The construction advantageously permits increases in the cross sectional areas of those flow passages and makes it possible to treat a large volume of molten metal efficiently within a short period of time. Furthermore, free of the bottom wall, the vessel body provides easy access from the bottom opening for fabrication of the lining or for lining repairs that require very little labor and time.

What is claimed is:

1. A molten-metal treatment vessel having an immersion drum immersible at the lower portion thereof into a bath of molten metal retained in a ladle for treating said molten metal wherein said metal is at least partly introduced into and out of said treatment vessel in a circulating flow, said treatment vessel comprising a vessel body having a lower section and an upper and lower end portion, said lower section open at said lower portion end thereof, and said immersion drum removably attached at the upper peripheral edge thereof to said lower end portion of said vessel body, said immersion drum including at least one upward flow passage and at least one downward flow passage contherein, said flow passages being spaced apart from each other, and in said immersion drum the ratio RS of the total cross sectional areas $(S_1+S_2)$ of said upward and downward flow passages, which is the sum of the least total cross sectional area $S_1$ of at least one upward passages and the least total cross sectional area $S_2$ of at least one downward flow passage, to the cross sectional area S of said opening at the lower end of said lower section of said vessel, is not less than 0.3.

2. The vessel according to claim 1 wheren said flow-passage space inside said immersion drum is separated by a partition wall into a plurality of spaces defining separate upward and downward flow passages.

3. The vessel accroding to claim 1 wherein a partition wall is formed in said lower section of said vessel defining an extension of said partition wall of said immersion drum.

4. The vessel according to claim 1 wherein a plurality of cylindrical support shells are retained in a cylindrical outer shell of said immersion drum and are lined with a refractory material to form upward and downward flow passages for said molten metal.

5. The vessel according to claim 1 or 4 wherein a plurality of support shells are retained in an outer shell of said immersion drum and are removably lined with fire bricks to form upward and downward molten-metal flow passages.

6. The vessel according to claim 1 or 2 wherein nozzle holes for issuing a gas for conveying said molten metal upward are formed through the inner wall of said at least one upward flow passage of said immersion drum.

7. The vessel according to claim 1, 3 or 4 wherein the cross sectional contours of said flow passages formed in said immersion drum are circular, elliptical, polygonal, or biconvex.

8. An apparatus for the treatment of molten metal for partial immersion of said apparatus into a container of said molten metal and for circulating a portion of said molten metal into and out of said device, said apparatus comprising:

an upper treatment section lined with a refractory material for treating said molten metal;

a lower immersion section for immersion into said molten metal removably attached to and communicating with said upper treatment section and lined with a refractory material, said lower section open at the bottom portion thereof and including therein at least one upward flow passage and at least one downward flow passage, said flow passages being spaced apart from each other, for flow of molten metal from said container into said upward flow passage, through said immersion section, into said upper treatment section, out said downward flow passage and into said container, wherein:

the ratio RS of the total cross-sectional area $(S_1+S_2)$ of said upward and downward flow passages, which is the sum of the total cross-sectional area $S_1$ of said at least one upward flow passage and that of the cross-sectional area $S_2$ of the said at least one downward flow passage, as to the cross-sectional area S of said opening at the bottom portion of said lower section, is not less than 0.3.

9. The apparatus according to claim 8 further including a plurality of openings disposed about the lower end of said upward flow passage for the injection of an inert gas through said openings thereby causing upward flow of said molten metal.

* * * * *